United States Patent [19]

Girodin

[11] Patent Number: 4,516,913

[45] Date of Patent: May 14, 1985

[54] MULTISTAGE DRUM COMPRESSOR

[75] Inventor: Marius G. Girodin, Paris, France

[73] Assignee: Techniques Girodin, Paris, France

[21] Appl. No.: 289,892

[22] Filed: Aug. 4, 1981

Related U.S. Application Data

[63] Continuation-in-part of Ser. No. 962,608, Nov. 21, 1978, abandoned.

[30] Foreign Application Priority Data

Nov. 30, 1977 [FR] France ..... 77 36022

[51] Int. Cl.[3] ..... F04B 39/06; F04B 3/00; F04B 1/14

[52] U.S. Cl. ..... 417/243; 417/269; 417/265

[58] Field of Search ..... 417/244, 254, 265, 266, 417/269

[56] References Cited

U.S. PATENT DOCUMENTS

| | | | |
|---|---|---|---|
| 676,401 | 6/1901 | Textorius | 417/265 |
| 860,826 | 7/1907 | Reauell | 417/265 |
| 1,082,156 | 12/1913 | Hurst | 417/269 |
| 1,367,914 | 2/1921 | Larson | 417/243 |
| 1,479,856 | 1/1924 | Humason et al. | 417/266 |
| 2,241,957 | 5/1941 | Poscara | 47/266 |
| 2,272,925 | 2/1942 | Smith | 62/6 |
| 2,463,486 | 3/1949 | Johnson | 417/265 |
| 2,715,875 | 8/1955 | Towler et al. | 417/206 |
| 2,915,974 | 12/1959 | Enemair | 417/265 |
| 3,478,511 | 11/1969 | Schwemin | 62/6 |
| 3,514,221 | 5/1970 | Hasquinolh et al. | 417/266 |
| 4,138,203 | 2/1979 | Slack | 417/269 |
| 4,155,683 | 5/1979 | Mochizuki | 417/269 |

FOREIGN PATENT DOCUMENTS

| | | | |
|---|---|---|---|
| 697248 | 9/1940 | Fed. Rep. of Germany | 417/269 |
| 2410750 | 8/1979 | France | 417/266 |
| 2116796 | 7/1972 | Italy | 417/265 |

*Primary Examiner*—William L. Freeh

*Attorney, Agent, or Firm*—Holman & Stern

[57] ABSTRACT

A multistage drum compressor has its stage cylinders arranged in ascending order around the axis of a shaft which operates the various stage pistons and which rotates in a direction opposed to the order of the stages, whereby the stage pistons are actuated in reverse stage order. The compressor incorporates internal ducts for providing interstage cooling of the gas being compressed by means of a circulating liquid coolant system.

2 Claims, 9 Drawing Figures

MULTISTAGE DRUM COMPRESSOR

This application is a continuation-in-part of my earlier filed U.S. application Ser. No. 962,608 filed Nov. 21, 1978 - now abandoned.

It is common practice to make multistage compressors of the axial-piston type with the gas being cooled between stages to prevent high temperatures arising and to increase efficiency.

In present-day multistage machines, with the volumes decreasing in the order of the stages located in the cylinder block, it is habitual to have each stage followed by an intermediate capacity outside the cylinder block designed to absorb the pressure changes during the exhausting of the said stage; this capacity can also at the same time form the cooling circuit combined with each stage. Such a layout is bulky and it absorbs energy unnecessarily.

According to the invention these drawbacks can be avoided by adopting a layout in which each stage discharges straight into the next stage, which has a smaller volume, although this requires the discharge from one stage to coincide with the intake of the next stage; in other words, the arrival of the piston at the top dead center occurs in reverse order to the path of the fluid inside the cylinders. Thus, if there are four cylinders marked respectively 1, 2, 3 and 4, these cylinders being evenly spaced in the order of increasing pressure obtained at the outlet around the center line of the cylinder block, the cylinder drive shaft must rotate in such a direction that the compression (or intake) order is 4, 3, 2, 1.

With this system the exhaust from one cylinder is made to coincide with the intake of the cylinder following it in the order of increasing compressions.

With this arrangement it is no longer necessary to provide an intermediate capacity, so that the cooling circuit can be made as compact as possible and therefore, according to another feature of the invention, the cooling circuits can be actually built into the cylinder block itself and located close to the corresponding cylinders. In an advantageous embodiment the cooling circuits are U-shaped with each arm of the U containing a heat exchanger bundle with the cooling liquid flowing countercurrent to the compressed fluid.

Another feature of the compressor is that it is characterized by the layout of the gas and cooling fluid systems inside the cylinder block in separate planes perpendicular to the axis of the block, with the inlets and outlets of the cooling circuit consisting of ports located on the internal face, except for the inlets and outlets of fluid to and from the appliance.

Other features of the invention will appear in the following description, given as an example, with reference to the appended drawings in which.

Figure 2:
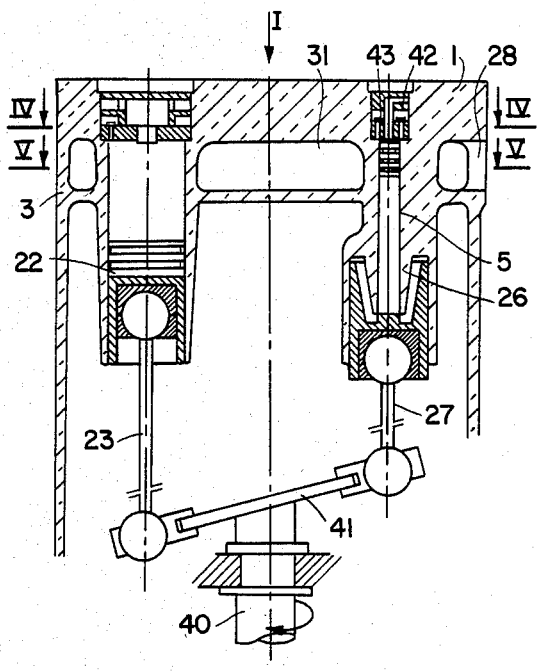
FIG. 2 is a section of FIG. 1 along II—II.
Figure 4:
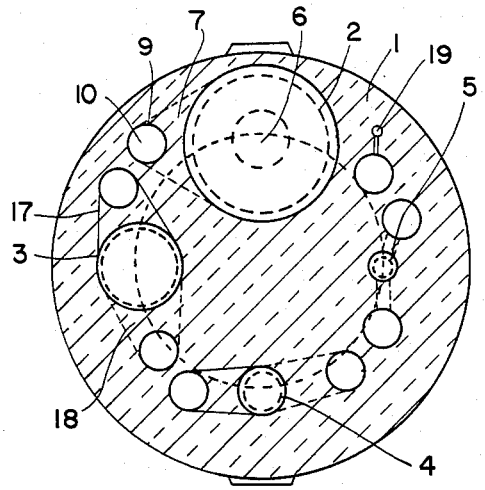
FIG. 4 is a section of FIG. 2 along IV—IV.

FIGS. *6a*, *6b*, *6c* and *6d* are diagrams of the respective positions of the pistons in the different operating phases of the compressor.

The appliance shown comprises a cylindrical barrel or cylinder block 1 containing cylinders spaced symmetrically round the axis and having decreasing volumes: cylinder 2 of the first compression stage, cylinder 3 of the second stage, cylinder 4 of the third stage and cylinder 5 of the fourth stage. These cylinders contain pistons which are given a reciprocating movement by means of the axial drive shaft 40 and the inclined plate 41, fixed to the shaft 40, and linked to piston rods 21, 23, 25, 27 by ball joints. Suction and discharge valves are placed at the inlet and outlet to the cylinders; these valves are indicated schematically at 42, 43 and may be concentric or superimposed.

According to the invention these various cylinders follow each other in phase order, for example, counterclockwise as shown in the drawing, with the air from cylinder 2 being discharged into cylinder 3, then into cylinder 4 and finally into cylinder 5, however, as will be explained later, the shaft and its combined (wobble) plate rotate in the opposite direction so that the compressions are performed in the order 5, 4, 3, 2.

Figure 3:
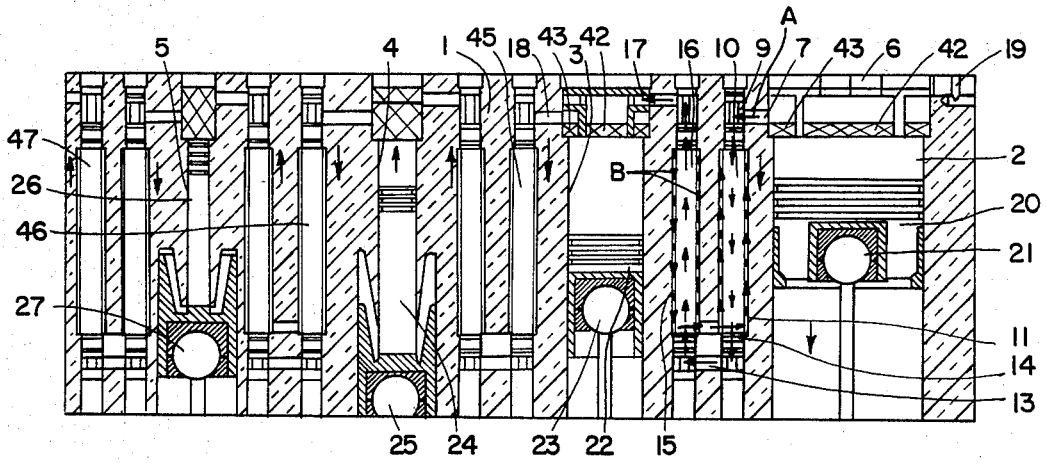
FIG. 3 is a developed view of the cylinder cutting through the compression cylinders and the coolers.

As can be seen more clearly from FIG. 3, pairs of holes are bored between cylinders 2, 3, 4 and 5 and are designed to take the cooler heat exchangers located after each cylinder. Each heat exchanger comprises an internal flow path for the compressed gas or fluid and an external flow path for the cooling liquid, the flows being countercurrent.

As can be seen from FIG. 3, the gas being compressed arrives from outside via the port 6 in first-stage cylinder 2 and leaves it at right angles to the axis of the cylinder barrel 1 via an internal discharge duct 7 connected with the head 9 of bore 11 which contains an arm of a heat exchanger bundle 10. At the base of bore 11 there are gas 13 and cooling liquid 14 passageways, the cooling liquid generally being water, which are connected to bore 15 which is parallel and close to bore 11, to form the two arms of the heat exchanger having two parallel bundles. The second tube bundle 16, in series with bundle 10, opens out into an internal axial port connected to the second-stage admission duct 17, i.e. to cylinder 3.

The gas is discharged from cylinder 3 via duct 18 into the following U-shaped heat exchanger 45 and then goes into cylinder 4. After being compressed in cylinder 4 it goes into the next heat exchanger 46 and thence into cylinder 5. Finally the gas escapes to the appliance using it after passing through heat exchanger 47.

A special feature of the system is that the gas and the cooling fluid flow through channels located in planes perpendicular to the cylinder block axis. Thus, the cylinder block 1 has three sets of internal ducts in different planes perpendicular to the axis.

Figure 5:
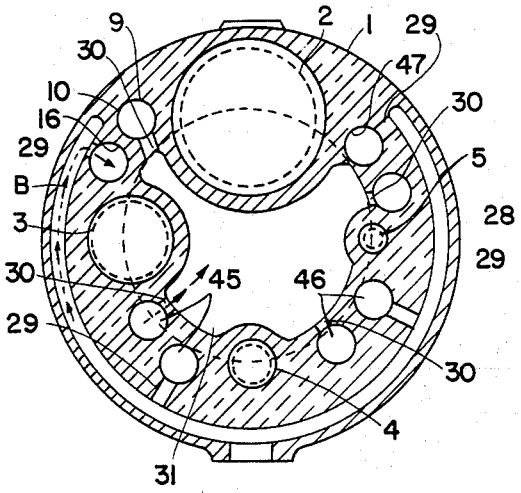
FIG. 5 is a section of FIG. 2 along V—V.

As can be seen in FIG. 3 and FIG. 5, the cooling water, represented by dashed arrow lines B, is admitted into the peripheral duct 28 and then flows through radial channels 29 into the heat exchangers at the level of the head of the second arm, whence it leaves the first arm of the U via channels 30 to go into the internal cylinder head cooling capacity 31 whence it is discharged. The cooling liquid, when flowing in the heat exchanger arm, flows in bore 15 along the outside of the tubes of heat exchanger 16 so that heat exchange is effected through the tube walls between the compressed gas and counter-flowing cooling liquid.

Those channels, such as 7 and 18, which transfer gas from a compression cylinder to the following heat exchanger, are situated in a plane which is offset axially with respect to the plane containing the channels, like 17, transferring the gas from a heat exchanger to the next compression cylinder.

The compressor's operation can easily be followed from the schematics in FIGS. 3 and 6.

Figure 1:
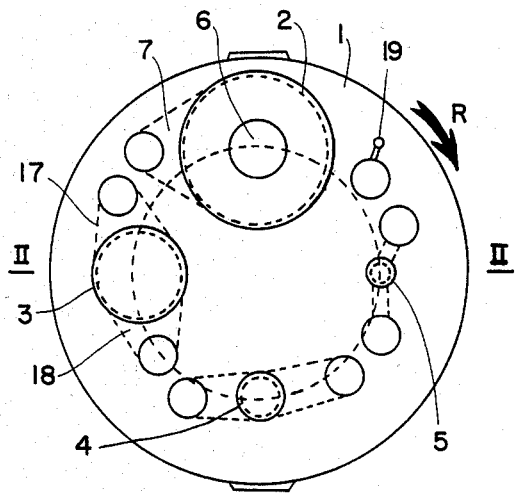
FIG. 1 is the end view of a four-stage compressor according to the invention, along arrow I in FIG. 2.

As has been stated before, the drive shaft 40 and its wobble or swash plate 41 rotate in the direction of the arrow in FIG. 1, i.e. in the opposite direction to the circuit of the fluid to be compressed in the compression cylinders, in the order 2, 3, 4, 5. Valves 42 and 43 allow the air to flow from an upstream cylinder to a downstream cylinder, but check flow in the reverse direction.

As a general rule, and in principle, each cylinder works in three stages: suction on the piston down stroke; compression; and then discharge on the next up stroke. However, the time taken by each of these three stages varies in accordance with the pressures of the upstream and downstream cylinders for the intermediate cylinders 3 and 4, and in accordance with the downstream cylinder or the upstream cylinder for cylinders 2 and 5. In fact a shift takes place which tends to equalize the suction, compression and discharge stages.

Figure 6D:
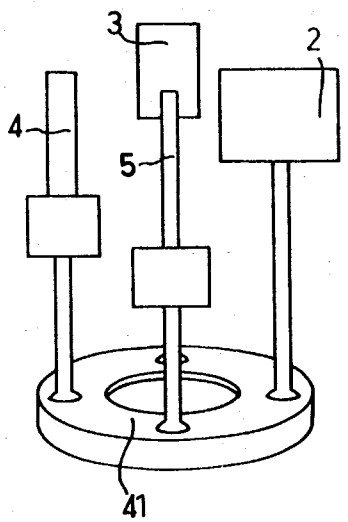
Figure 6C:
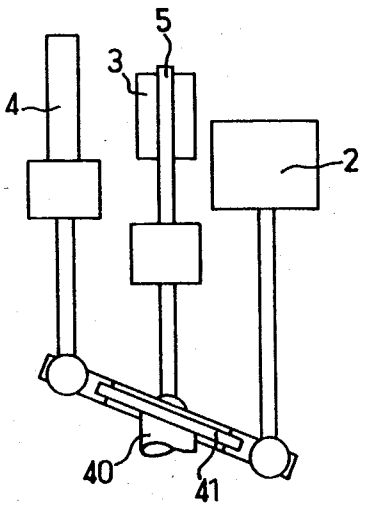
Figure 6B:
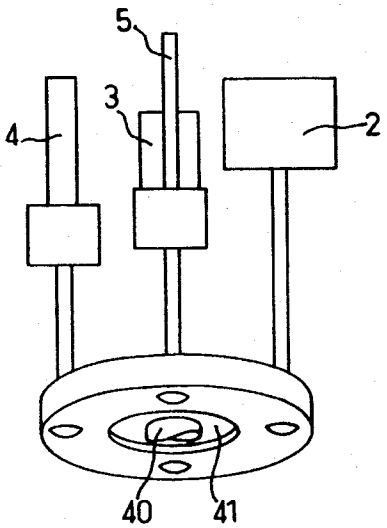
Figure 6A:
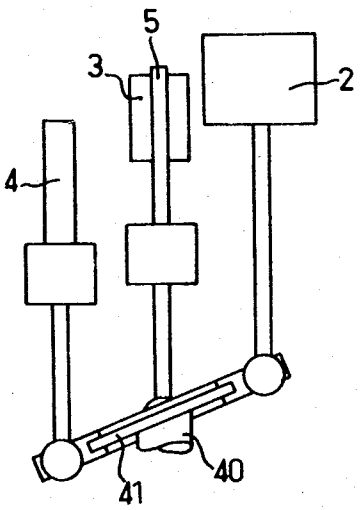

If we start with the position of FIG. 6*a* for which the piston of cylinder 2 is in its top dead point position (TDP, or PMH in French), and then go to the position of FIG. 6*b*, the air which it contained completes its transfer into cylinder 3 (which was in its top dead point position in the preceding phase) whose volume increases as the volume of cylinder 2 decreases. The arrangement of the invention thus permits direct transfer from one cylinder to the next.

In this phase cylinder 2 is beginning to fill.

Cylinder 4 of the third stage has reached the bottom dead point, has filled up in the preceding phase with air coming from cylinder 3 of the second stage and is ready to go into the compression phase.

Cylinder 5 of the fourth stage is in the compression stage until the pressure for discharge into the fed appliance has been reached.

From the position of FIG. 6*b* to the position of FIG. 6*c*, cylinder 2 continues to fill up at normal pressure.

Cylinder 3 of the second stage goes into the compression phase, whilst the piston of cylinder 4 discharges the gas into cylinder 5 in the suction phase.

From the position of FIG. 6*c* to the position 6*d*, cylinder 2 is in the compression phase whilst cylinder 3 discharges the air into cylinder 4 which is in suction, as is cylinder 5.

From the position of FIG. 6*d* to the position of FIG. 6*a*, cylinder 2 is in the phase of discharge into cylinder 3, which is sucking as is cylinder 4, whilst cylinder 5 is in the compression phase.

Thus, with this layout and this direction of rotation, each of the cylinders successively discharges the air it contains into the following cylinders without it being necessary to resort to an intermediate capacity.

What is claimed is:

1. A multistage drum compressor, comprising:

a drum having a longitudinal axis;

a plurality of piston and cylinder stages of different volume defined in said drum at angularly spaced locations in a first direction about said longitudinal axis, said stages defining an angular positional sequence about said longitudinal axis in which a first stage in the sequence has the largest volume of the stages, the last stage in the sequence has the smallest volume of the stages, and each stage in the sequence has a smaller volume than the preceding stage in the sequence;

a first plurality of flow passage means defined in said drum for conducting gas to be compressed to each of said stages sequentially in said angular positional sequence;

actuator means for sequentially actuating the pistons in said stages to compress gas therein in an order which is opposite to said angular positional sequence; and a second plurality of flow passage means defined in said drum for conducting a coolant fluid in flow-isolated heat exchange relation with said first plurality of flow passage means;

wherein each of said first plurality of flow passage means each includes;

an outlet duct defined in said drum and extending from a respective one of said stages in a direction generally perpendicular to said longitudinal axis;

a first longitudinal passage means defined in said drum extending parallel to said longitudinal axis and connected to said outlet duct to receive pressurized gas therefrom;

an intermediate duct defined in said drum, connected to said first longitudinal passage means to receive pressurized gas therefrom, and extending generally perpendicular to said longitudinal axis;

a second longitudinal passage means defined in said drum extending parallel to said longitudinal axis transversely spaced from said first longitudinal passage means, and connected to intermediate duct to receive pressurized gas therefrom; and an inlet duct for the next stage in said sequence which follows said respective one of said stages, said inlet duct being defined in said drum and extending between said second longitudinal passage means and said next stage generally perpendicular to said longitudinal axis;

wherein said first and second longitudinal passages means conduct pressurized gas in opposite longitudinal directions within said drum.

2. The multistage compressor according to claim 1:

wherein each of said second plurality of flow passage means comprises: a first coolant duct defined in said drum and disposed concentrically about the first longitudinal passage means in a respective one of said first plurality of flow passage means; a second coolant duct defined in said drum and disposed concentrically about the second longitudinal passage means in said respective one of said first plurality of flow passage means; and a connecting duct for conducting coolant fluid flow between said first and second coolant ducts, said connecting duct being defined in said drum and extending generally perpendicular to said longitudinal axis;

and further comprising: reservoir means for supplying coolant fluid under pressure to the first coolant duct in each of said second plurality of flow passage means; and outflow means for receiving coolant fluid from the second coolant duct in each of said second plurality of flow passage means.

* * * * *